United States Patent [19]

Windele

[11] 4,131,358

[45] Dec. 26, 1978

[54] DEVICE FOR MOVING A PATH OF A MOVING DATA CARRIER TOWARD AND AWAY FROM A SURFACE AREA OF A SUB-CARRIER

[75] Inventor: Josef Windele, Puchheim, Germany

[73] Assignee: Siemens Aktiengesellschaft, Berlin, Germany

[21] Appl. No.: 820,216

[22] Filed: Jul. 29, 1977

[30] Foreign Application Priority Data

Aug. 12, 1976 [DE] Fed. Rep. of Germany ..... 2636326

[51] Int. Cl.[2] ..... G03G 15/044; B65H 23/26

[52] U.S. Cl. ..... 355/3 TR; 101/228; 226/89; 226/110; 226/196; 226/200

[58] Field of Search ..... 226/91, 89, 109, 110, 226/113, 114, 196, 198, 199, 200, 195, 34, 176; 355/3 R, 3 TR, 3 TE; 101/228 X; 346/153, 165

[56] References Cited

U.S. PATENT DOCUMENTS

| | | | |
|---|---|---|---|
| 3,311,280 | 3/1967 | Larson et al. | 226/195 |
| 3,914,042 | 10/1975 | Watson | 355/3 TR |

OTHER PUBLICATIONS

Crawford, R. P., "Transfer Zone Paper Control," *IBM Tech. Disclosure Bulletin,* vol. 14, No. 4, Sept. 1971, p. 1226.

*Primary Examiner*—Bruce H. Stoner, Jr.
*Attorney, Agent, or Firm*—Hill, Gross, Simpson, Van Santen, Steadman, Chiara & Simpson

[57] ABSTRACT

A device for moving a path of a moving data carrier toward and away from a surface area of a sub-carrier characterized by two pivotal support members which are mounted to pivot about respective pivot points and are pivotable between a first or forward position with a data carrier disposed closely adjacent the surface area of the sub-carrier and a second or outward position with the data carrier spaced from the suface area of the sub-carrier. The pivotal support members each have a first engaging zone and a second engaging zone and are symmetrically disposed relative to a center of the contact area so that the data carrier is in continual engagement with all of the engaging zone and maintained under a constant tension regardless of the position of the support members.

13 Claims, 3 Drawing Figures

DEVICE FOR MOVING A PATH OF A MOVING DATA CARRIER TOWARD AND AWAY FROM A SURFACE AREA OF A SUB-CARRIER

BACKGROUND OF THE INVENTION

1. Field of the Invention

The present invention is directed to a device for moving a path of a data carrier toward and away from a surface area of a sub-carrier and, in particular, for moving a traveling paper web toward and away from a photoconductive sub-carrier in a reproducing station of an electrostatic printer.

2. Prior Art

In mechanical, high speed printers, it is known that the paper web on which printing is to be applied must be exactly conducted passed the printing position in the printing station in order to obtain a clean print thereon. For these reasons, corresponding paper guides are provided for guiding the paper through the printing station. A similar problem also exists in non-mechanical printing such as an electrostatic printing. An electrostatic high speed printer may, for example, consist of an electro photographic high speed printer in which the printed information is projected photo optically onto a photoconductive surface, such as a drum which had been charged electrostatically over its entire surface. The latent charge image of the information to be printed is produced in this manner and is developed in a developing station with ink powders which is a so-called toner. In the reproducing station, the powder image on the surface of the drum is transferred to a paper web by the effect of an electrostatic field.

In order to be able to satisfactorily transfer the powder image from the photoconductive surface, which is referred to as a sub-carrier, to a paper web, which is referred to as data carrier, a certain length of the data carrier must be brought toward and into contact with the sub-carrier. On the other hand, the data carrier must be able to be removed again from the sub-carrier, particularly during pauses in the printing process or in the case of a disturbance in the device.

SUMMARY OF THE INVENTION

The present invention is directed to a device for moving a path of a moving data carrier toward and away from a surface area of a sub-carrier. This is accomplished by the device comprising means supporting and moving a data carrier along a given path, said means for supporting and moving including two pivotal support members or gallows, each of said support members or gallows being mounted on a frame to pivot around the respective pivot points, and means for pivoting the support members between the first or forward position with the data carrier disposed closely adjacent the surface area of the sub-carrier and a second or outward position with the data carrier spaced from the surface area of the sub-carrier, each of said pivot points being arranged symmetrically to a point on the surface area of the sub-carrier at which the data carrier lies closest to the sub-carrier as the support members assume said first position, each of said support members having a first data carrier engaging zone on one side of its pivot point adjacent said point of said surface area and a second data carrier engaging zone on the opposite side of its pivot point, each of said data carrier engaging zones being in continual engagement with the data carrier and of a configuration so that the data carrier is tautly engaged by said zones regardless of the position of the pivotal support members.

The engaging zone of the support members are disposed on each of the support members in such a way that the length of the data carrier, which is engaged between the engaging zones of the pair of support members is substantially the same regardless of whether the support members are in the first or the second positon. In this way, the length of the data carrier such as a moving paper web, which is engaged on the engaging zones and is moved by the movement of the support members, is very small.

For the movement of the support members, each of the support members is provided with a rocker arm which supports a roller. Each roller is in contact with a separate cam disposed on a cam shaft. As a result of rotation of the cam shaft, the support members can be moved or pivoted between their first and second positions. An advantage of this design is that the support members can take the form of relatively small, low mass components. Furthermore, they are only required to be pivoted by a very small angle in order to pass from one position to the other position and consequently, the effective mass, which is required to be moved fundamentally consists of only the cam shaft, the cams and possibly the drive motor for the cam shaft. As a result of this design of the device, the pivoting process requires only a very short length of time.

In addition to the pivotal support members, fixed support members or support gallows can be provided to further support the data carrier. With the aid of the drive device, which consists of a pair of feed means, the data carrier is maintained in contact with both the feed and the pivotal support members. In this way, it is assured that in the event of a pivotal movement of the pivotal support members, the moving parts of the data carrier is that part which lies between the fixed support members. By virtue of the choice of the design of the pivotal support members and the position of their pivot points, the length of the paper which is supported between the fixed support members remains substantially constant with only negligible deviations. For this purpose, the length of the data carrier, which is produced by a release of pressure due to the movement of one of the first or second engaging zones of the pivotal support member is immediately taken up by the movement of the other engaging zone of the same support member. In this way, the data carrier is supplied to and removed from the sub-carrier in a virtually radial direction. This avoids the powder image from becoming blurred as a result of relative movement in the direction of travel or as a result of the data carrier becoming slack or being flexed in the region of the photoconductor.

The cams on the cam shaft for the pivotal support members can possess different designs and may be angularly displaced so that the pivotal support members are not pivoted simultaneously toward or away from the sub-carrier but are pivoted in a sequential manner. An advantage of the sequential pivoting consists in the fact that the data carrier can be removed from the sub-carrier without any damage to an image transferred thereto.

It is advantageous to arrange all of the moving mechanical components of the device on a side of the data carrier which is opposite to the side that is engaged or faces the sub-carrier. This is because in the reproducing station of an electrostatic printer the powder images are not yet fixed and, therefore, can be easily blurred. However, since the mechanical components all lie in a side opposite to this surface of the data carrier receiving the powder images, the mechanical components cannot influence or contact the toner side or image side of the data carrier.

DESCRIPTION OF THE PREFERRED EMBODIMENTS

Figure 1:
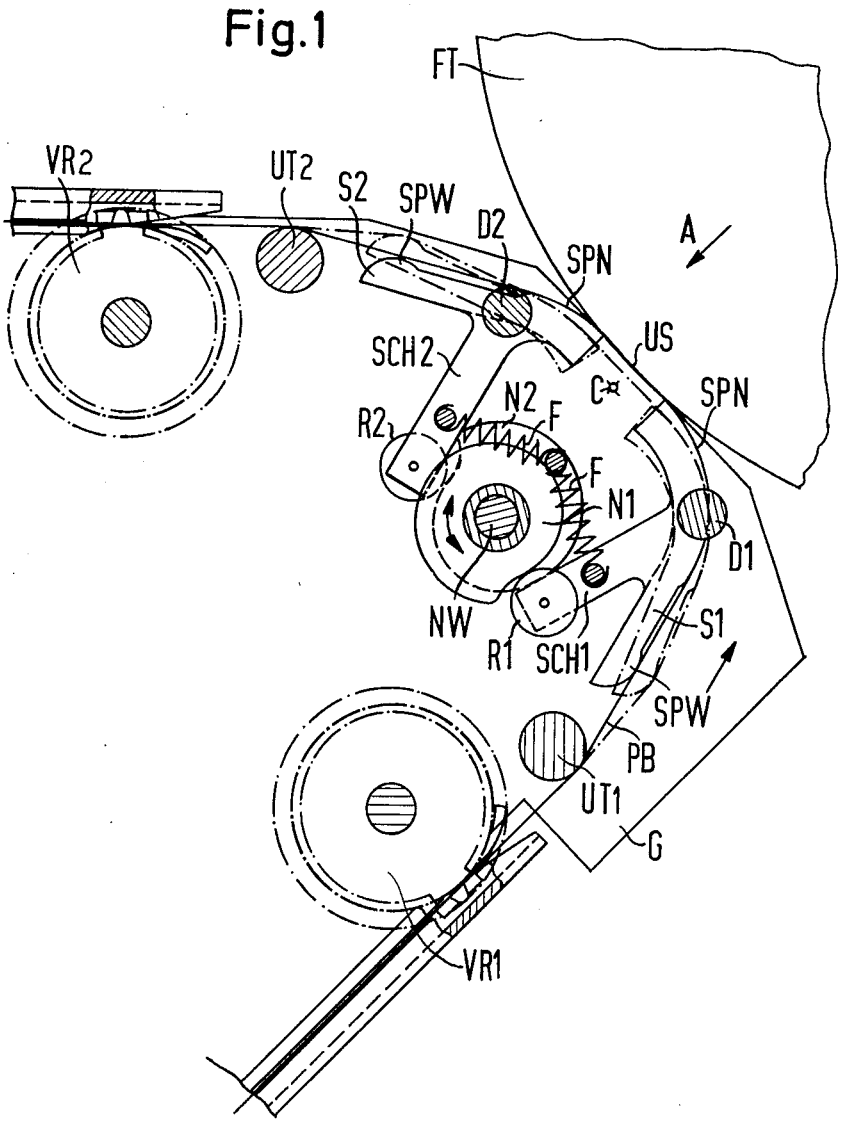
FIG. 1 is a side view with portions in cross section for purposes of illustration of the device of the present invention.

The principles of the present invention are particularly useful in a device for moving a path of a moving data carrier toward and away from a surface area of a sub-carrier. As illustrated in FIG. 1, the device is shifting or moving the path of a moving paper web PB toward and away from the surface area of a photoconductive drum FT at a reproductive station US of an electrostatic printer.

The device of the present invention includes a pair of pivotal support members or gallows S1 and S2, which are employed to guide the paper web PB in the reproducing station US. The pivotal support member S1 is mounted in a frame member G for pivotal movement around a pivot point shown by pivot shaft D1. In a similar manner, the pivotal support member S2 is mounted between the frame members G to pivot on a pivot point D2 which is also a pivot shaft. The pivot points represented by the shafts D1 and D2 are symmetrically arranged about a center point of the station US and as illustrated, the pivotal support member S1 is in mirror image relationship to the member S2. The members S1 and S2 have first data carrier engaging zones SPN and second engaging zones SPW. As illustrated, the zones SPN are adjacent ends of each of the members S1 and S2 which are facing each other, while the second zones SPW are spaced further away on the opposite side of the space pivots D1 and D2. Also, it should be noted that the engaging zones have a curved surface and, as illustrated, the second engaging zones SPW are formed by a curved surface of a bump.

Each of the pivotal members S1, S2 is provided with a rocker arm SCH1, SCH2, respectively. A roller R1 and a roller R2 are arranged and supported on the ends of these rocker arms SCH1 and SCH2. The rollers R1 and R2 are in contact with cams N1, N2, which are on a cam shaft NW which forms part of a means for pivoting the pivotal members S1, S2. As illustrated, the roller R1 is in contact with the cam N1 while the roller R2 is in contact with the surface of the cam N2. To ensure the contact between the rollers and their respective cam surfaces, biasing means such as springs F extend between pins on each of the rocker arms SCH1 and SCH2 and a pin on the frame member such as G (see FIG. 2).

The device further includes a pair of fixed support members UT1 and UT2 which are arranged on the frame member such as G so that the pivotal support members S1 and S2 are disposed therebetween. As illustrated in FIG. 1, when the paper web PB is moved in a direction of the arrow, it is first engaged on the fixed support member UT1, then is engaged on the pivotal support member S1, S2 and then the second fixed support member UT2.

Figure 2:
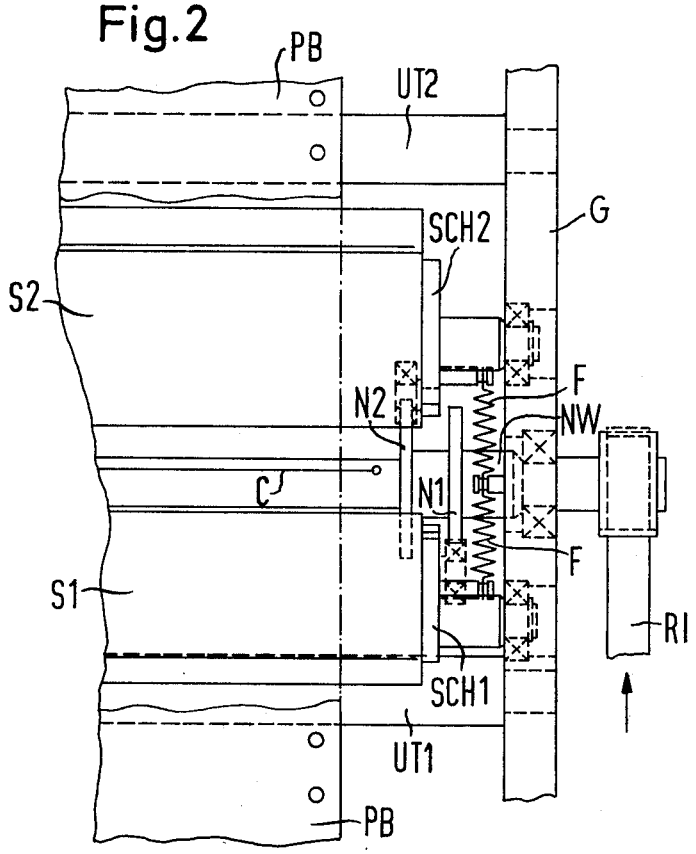
FIG. 2 is a partial plan view taken in a direction of arrow A of FIG. 1 of the device in accordance with the present invention.

To aid in moving the web PB in the path defined by the various fixed support members and pivotal support members, a pair of feed means VR1 and VR2 are provided. As illustrated feed means VR1 is mounted on the frame to feed the strip PB into engagement with the fixed support member UT1 and the feed means VR2 is positioned to receive the web PB as it is disengaged from the second fixed support member UT2. As illustrated, the feed means VR1 and VR2 each consist of rollers which are provided with sprocket pins which are received in space perforations which, as illustrated in FIG. 2, are provided on the paper web PB adjacent the edge thereof. By controlling the speed of rotation of the feed means VR1 and VR2 relative to each other, the paper web PB may be maintained at the desired tension as it is supported on the various fixed and pivotal support means.

The means for pivoting which is formed by the cams N1 and N2 and the cam shaft NW will pivot the pivotal support members S1, S2 from a first or forward position, which is illustrated in bold lines and holds the web PB closely adjacent or on the surface of the drum FT, to a second or outward position with the web radially spaced therefrom as illustrated in chain lines. It should be noted that actual transfer of the image from the surface of the drum onto the paper is accomplished by an electrostatic force which is provided by a corotron wire or corona discharge wire C which is illustrated as disposed between the facing ends of the two pivotal support members S1 and S2.

The cam shaft NW is mounted in one part of the housing or frame member G and is driven by a drive means via a belt R1 (FIG. 2). It is noted that in FIG. 2, only half of the device is illustrated and the opposite or other un-illustrated half is substantially the same with the exception that the other end of the cam shaft NW is supported by a bearing on the frame member similar to G. In FIG. 2, the relationship of the fixed support members UT1 and UT2 relative to the pivotal support membes S1 and S2 is illustrated. In addition, the axial position of the cam members N1 and N2 on the cam shaft NW is shown. In addition, each of the support members such as the fixed support members UT1 and UT2 as well as the pivotal support members S1 and S2 extend across the entire width of the paper web PB.

At the beginning of the process, both the pivotal support members S1 and S2 are pivoted to the second or outward position so that the data carrier or paper web PB is spaced from the surface of the sub-carrier or photoconductive drum FT. As illustrated in FIG. 1, they will occupy the position illustrated in chained lines. In order to pivot the support members S1 and S2 toward the first position, the cam shaft NW is rotated and the rollers R1 and R2 are moved along their respective cams N1 and N2 and thus approach one another. As a result, the pivotal support members S1 and S2 are turned about the pivots D1 and D2. The ends of the support members S1 and S2, which face one another then move in the direction toward the photoconductive drum FT. This position of the gallows or support members S1 and S2 is illustrated in solid lines in FIG. 1. If the paper web PB is to be pivoted away from the photoconductive drum FT, the cam shaft NW is rotated and the rollers R1 and R2 are moved away from one another. As a result, the members S1 and S2 will be turned about their pivots D1 and D2 in such a way that the ends facing one another are moved away from the photoconductive drum FT.

The surface design of the pivotal support members S1 and S2, the location of the pivot points D1 and D2, and the shape of the cams on the cam shaft are such that the paper web PB is always held in a taut condition regardless of the paticular position of the pivotal members. This is because the powder image would become blurred during the electrostatic printing if the length of paper engaged on the pivotal support members became slack or changed. In the event of a break in the paper supply, the pivotal support members S1 and S2 are printed on their pivots D1 and D2 with the aid of the cam shaft NW to the second position so that the engaging zones SPN of the members S1 and S2 which are adjacent the reproducing station US are pivoted or moved away from the photoconductive drum FT. As this occurs, the second engaging zones SPW, which are on the opposite side of the pivots from the first zones will pull or take up the length of paper, which is released at the reproduction zone so that the paper is still maintained at the desired tension without any slack, wrinkles or sags. Due to this action, the paper web PB will be lifted radially from the photoconductive drum FT. The described process may take place in this general fashion while the paper web and the photoconductive drum still possess a full transport speed so that during a break in the paper supply, no relative movement can occur between the paper web and the photoconductive drum and, therefore, the powder image will not become blurred.

As the paper web PB is always in contact with the fixed support or gallows UT1 and UT2 during the pivoting of the first or forward position and during the pivoting to the second or outward position by the pivotal support members S1 and S, only the length of the paper extending between the fixed support members UT1 and UT2 is involved with the shift in the path of the data carrier. This means only a relatively short length of paper and thus a small paper mass is involved with the shifting of the path and the shifting or pivoting of members S1 and S2 between the first and second positions can take place at high speed. Due to the aid of the feed means VR1 and VR2 and the coaction of the engaging zones on the pivotal members, the paper web disposed between the fixed support members UT1 and UT2 always remains at the desired tension and can be moved by the pivoting of the pivotal support members S1 and S2 without any change in the tension and without the powdered image on the paper web becoming blurred.

The relative arrangement of the rocker arms SCH and the associated roll R with the cam shaft NW can be such that in the event of failure of the spring F, the photoconductive drum cannot become damaged. In fact, the smallest cam radius of the cams N1 and N2 produces the smallest distance between the pivotal support members S1 and S2 to the surface of the photoconductive drum.

Figure 3:
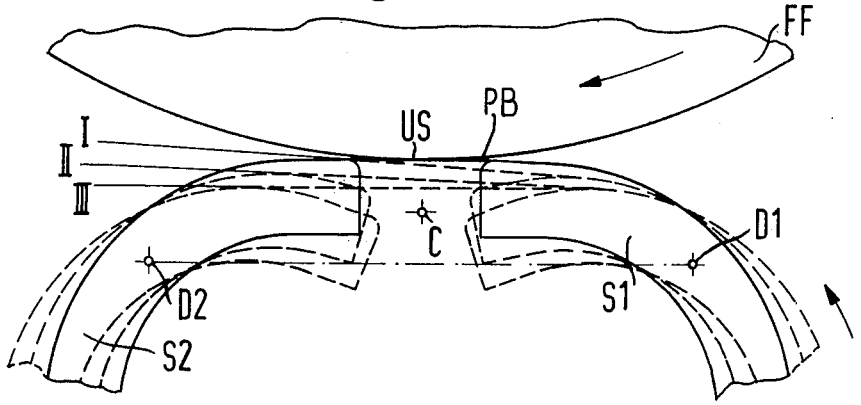
FIG. 3 is an illustration of the movement of the data carrier as the support members are sequentially pivoted to withdraw the data carrier from the surface area of the sub-carrier.

FIG. 3 shows the manner in which a paper web PB can be pivoted or moved away from the surface of the photoconductive drum FT. As illustrated in FIG. 3, the drum FT and web PB are moving in the same direction indicated by the arrows. Assuming that the web PB is in position adjacent the surface of the drum FT at the station US as illustrated in bold lines, the paper web is, in fact, held onto the drum as a result of electrostatic field produced by the wire C.

As a result of the construction and arrangement of the cams N1 and N2 on the cam shaft NW, during withdrawal of the web from contact with the surface, the pivotal support member S1 will be pivoted approximately two-fifths of its total movement toward the second position prior to any pivoting of the support member S2. The paper web will thus be withdrawn from the photoconductive drum FT until it merely forms a tangent to the photoconductive drum which is illustrated by position I in FIG. 3. Then, as the second or other pivotal support member S2 is moved from the first position toward the second position, the paper web is displaced away from the surface of the drum with the web being substantially parallel to the position of the web as its assumed position I. It should be noted that position II is when the member S1 is in the second position and the member S2 is moving toward the second position. After completion of the pivoting of the member S2 to the second position, the web will assume position III with the web being displaced its maximum distance from the surface of the drum FT, which is approximately 2.5 mm.

In this sequence of movement or pivoting, the paper web is withdrawn from the photoconductive drum FT in the direction of the drum rotation. It is also being constantly offerred to the drum at a different angle.

The forward pivoting or movement of the paper from the position III to the position engaging the drum will occur in a reverse sequence with the pivotal member S1 being pivoted toward the first position prior to movement of the member S2 toward the first position. It should be noted that instead of moving the pivotal members S1 and S2 in a sequential manner, thay can be moved simultaneously to move the web between the second or removed position to the first or forward contacting position.

As noted hereinabove, the actual contact of the web on the surfaces of the drum is produced by an electrostatic force. To adjust the length of the web which will be in contact with the drum, the entire frame of the device such as the frame member G can be moved in a radial direction to the axis of the photoconductive drum FT by conventional adjustment means.

As best illustrated in FIG. 1, it should be noted that the particular configuration of the pivotal members S1 and S2 as well as their engaging zones SPN and SPW are such that during the pivotal movement between the first position illustrated in bold lines to the second position illustrated in chain lines, the length of the paper PB engaged between the fixed supports UT1 and UT2 remain substantially the same. In other words, the outward movement of the engagement zones SPW during movement or pivoting to the second position compensates for the inward displacement of the first engagement zones SPN.

Although various minor modifications may be suggested by those versed in the art, it should be understood that I wish to embody within the scope of the patent warranted hereon, all such modifications as reasonably and properly come within the scope of my contribution to the art.

I claim:

1. A device for moving a path of a moving data carrier toward and away from a surface of a sub-carrier and particularly for moving a path of a moving paper web toward and away from a surface area of a photoconductive sub-carrier at a reproducing station of an electrostatic printer, said device comprising means supporting and moving a data carrier along a given path, said means for supporting and moving including two pivotal support members, each of said support members being mounted on a frame to pivot around respective pivot points, and means for pivoting said support members between a first position with the data carrier disposed closely adjacent the surface area of the sub-carrier and a second position with the data carrier spaced from the surface area of the sub-carrier, each of said pivot points being arranged symmetrically to a point on the surface area of the sub-carrier at which the data carrier lies closest to the sub-carrier as the support members assume said first position, each of said support members having a first data carrier engaging zone on one side of its pivot point adjacent said point on said surface area and a second data carrier engaging zone on the opposite side of its pivot point, each of said data carrier engaging zones being in continual engagement with the data carrier and of a configuration so that the data carrier is tautly engaged by said zones regardless of the position of the pivotal support members.

2. A device according to claim 1, wherein the first and second enaging zones of each of the support members are positioned relative to the pivot of each support member so that the length of the data carrier engaged between the second zones of the two support members remains substantially constant when the support members are in either the first or second position.

3. A device according to claim 1, wherein each of the support members on a surface opposite to the engaging zones is provided with a rocker arm, and wherein each of the rocker arms supports a roller thereon.

4. A device according to claim 3, wherein the means for pivoting include a cam shaft, said cam shaft having a separate cam for each of said rocker arms, and includes means for biasing each of the rollers of the rocker arms onto its respective cam.

5. A device according to claim 4, wherein each of the pair of cams on said cam shaft are angularly offset relative to each other so that one of the pivotal support members begins its movement between the first and second position prior to the other pivotal support member beginning said movement.

6. A device according to claim 1, wherein each of the support members extends along the entire width of the data carrier.

7. A device according to claim 1, wherein the means for supporting a data carrier includes a pair of fixed support members, each of said fixed support members being arranged on the path of the data carrier with the pivotal support members disposed therebetween so that the data carrier path extends from one of said fixed support members across the two pivotal support members and then to the other fixed support member, and wherein the only part of the data carrier path which is changed as the pivotal support members move between the first and second positions is the part extending between the pair of fixed support members.

8. A device according to claim 7, wherein the means for moving the data carrier along a given path includes a pair of feed means, one of said feed means being disposed to feed the data carrier onto one of the said fixed support members and the second of said pair of feed means receiving the data carrier after it has passed the other of the fixed support members.

9. A device according to claim 8, wherein the tension applied to the data carrier can be adjusted by adjusting the rate of feed of one of said feed means.

10. A device according to claim 8, wherein each of the feed means engaging the data carrier engage a surface of the data carrier facing away from the sub-carrier.

11. A device according to claim 1, wherein at least one of said first and second engaging zones includes a bump-like surface.

12. A device according to claim 1, wherein the pivotal support members are adjustably mounted relative to the position of the data carrier so that while the support members are in said first position the path of the data carrier can be adjusted relative to the surface area of the sub-carrier.

13. A device according to claim 1, wherein the sub-carrier is a photoconductive drum, and said data carrier is a paper web, wherein a powder image applied on the photoconductive drum is transferred to the paper web and said device includes at least one corona discharge wire positioned between the pivotal support members for causing an electrostatic field to transfer the powder image between the drum surface and the paper web.

* * * * *